United States Patent [19]

Stidworthy

[11] Patent Number: 4,862,842

[45] Date of Patent: Sep. 5, 1989

[54] ARRANGEMENTS FOR CONVERTING ROTARY MOTION INTO LINEAR MOTION

[76] Inventor: Frederick M. Stidworthy, 2 Butlers Close, Long Compton, Nr. Shipston-on-Stour CV36 5JY, Warwickshire, England

[21] Appl. No.: 320,120

[22] Filed: Mar. 7, 1989

Related U.S. Application Data

[63] Continuation of Ser. No. 96,025, Jul. 17, 1987, abandoned.

[30] Foreign Application Priority Data

Oct. 26, 1984 [GB] United Kingdom ..... 8427915

[51] Int. Cl.[4] ..... F01L 1/04

[52] U.S. Cl. ..... 123/90.6; 123/90.27

[58] Field of Search ..... 123/90.2, 90.6, 90.27, 123/90.48; 74/25, 55, 567, 568 R

[56] References Cited

U.S. PATENT DOCUMENTS

| | | | |
|---|---|---|---|
| 1,127,610 | 2/1915 | Fischer | 123/90.48 |
| 1,169,690 | 1/1916 | Smith | 123/90.48 |
| 4,590,812 | 3/1986 | Brackett | 74/55 |

*Primary Examiner*—Willis R. Wolfe
*Assistant Examiner*—M. Macy
*Attorney, Agent, or Firm*—Marshall, O'Toole, Gerstein, Murray & Bicknell

[57] ABSTRACT

An arrangement for converting rotary motion of a camshaft into linear motion of a reciprocable valve employs a reciprocable cam which is rotatable with the camshaft but is radially displaceable relative to the camshaft which extends through a slot-shaped aperture in the reciprocable cam. The profile of the reciprocable cam is held in engagement with a fixed reference roller and the bucket of valve is held in engagement with output rings on the cam. In the course of rotation of the camshaft, the cam lobe causes radial displacement of the cam on the camshaft with attendant movement of the valve.

11 Claims, 4 Drawing Sheets

ARRANGEMENTS FOR CONVERTING ROTARY MOTION INTO LINEAR MOTION

BACKGROUND OF THE INVENTION

This Application is a Continuation of my copending application Ser. No. 07/096 025 filed July 17, 1987 now abandoned.

The present invention relates to an arrangement for converting rotary motion into linear motion, such arrangement finding application in converting the rotary motion of a camshaft into linear motion of a reciprocable valve.

It is envisaged that the present invention will find particular application in internal combustion engines, in which environment it enables the timing and profile of a valve event to be varied.

BRIEF SUMMARY OF THE INVENTION

According to the present invention, there is provided an arrangement for converting rotary motion into linear motion, comprising: a first member; means supporting the first member for rotation about an axis; a second member; means guiding the second member for linear movement in a direction transverse to the axis of rotation of the first member; a follower member having a cam surface and carried by the first member for rotation with the first member around the axis of rotation of the first member; means guiding the follower member for limited linear displacement relative to the first member transversely of the axis of rotation of the first member; and a fixed reference point located at a predetermined distance from the axis of rotation of the first member; the follower member being disposed between the fixed reference point and the second member with the follower member held in contact with the second member and the cam surface of the follower member held in engagement with the reference point, whereby on rotation of the first member the follower member imparts linear movement to the second member in the direction transverse to the axis of rotation of the first member.

BRIEF DESCRIPTION OF THE DRAWINGS

In order that the invention may be readily understood, embodiments thereof will now be described, by way of example, with reference to the accompanying drawings, in which.

DETAILED DESCRIPTION OF THE PREFERRED EMBODIMENTS

Figure 1:
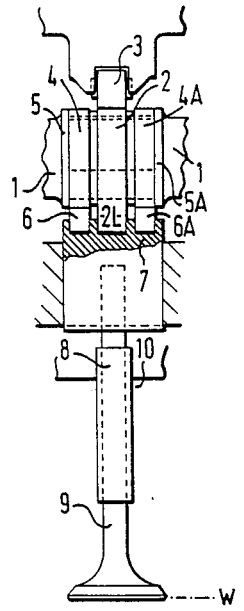
FIG. 1 is a partially sectioned front elevational view of a first poppet valve arrangement embodying the present invention.

In the various FIGS. of the drawings like parts are indicated by the same or like reference numerals.

Referring firstly to FIGS. 1 to 6, a first arrangement embodying the invention for converting rotary motion to linear motion comprises a camshaft 1 which is rotatable to cause linear displacement of a conventional poppet valve 9 guided for linear movement in a valve guide 8 and provided with a valve bucket 7 which is biased upwardly in FIG. 1 by a valve return spring (not shown) acting between the bucket 7 and a spring seat 10 in order to hold the valve 9 in a normally closed position.

The camshaft 1 has a pair of parallel flat surfaces extending parallel to the axis of rotation of the camshaft. A cam 2 having a lobe 2L is received on the camshaft 1 in an axially fixed position but so as to be slidably guided by the parallel surfaces of the camshaft for movement in a direction transverse to the axis of rotation of the camshaft. A reference roller 3 is mounted in a predetermined fixed position relative to the axis of rotation of the camshaft 1 on the centre line of the valve 9 above the cam 2 which is held in contact with the roller 3 by the action of the valve spring.

The cam 2 does not directly engage the valve bucket 7, but is provided with a pair of circular output rings 4 and 4A which form a unit with the cam 2 so as to be rotatable with the cam 2 and slidable with the cam on the parallel surfaces of the camshaft 1. Each of the output rings 4, 4A engages a respective bucket roller 6 mounted on the upper surface of the valve bucket 7, the roller 6 being biased into engagement with the output rings 4, 4A by the action of the valve spring. The cam unit consisting of cam 2 and output rings 4, 4A is axially located on the camshaft 1 by guide plates 5, 5A. The reference roller 3 is a free-running item supported by a suitable carrier.

In use, the camshaft 1 is rotated in the direction R which could, of course, be either rotational direction. As the camshaft 1 is rotated, the cam 2 rotates with the camshaft and, as the lobe 2L comes into contact with the reference roller 3 during the course of this rotation, the cam 2 and its output rings 4, 4A are forced to slide on the camshaft transversely of the axis of rotation, thereby applying pressure to the valve bucket 7. The output rings 4, 4A transmit this downward pressure to the valve bucket rollers 6, 6A and the valve 9 is thereby moved into an open position against the force of the valve spring.

Figure 2:
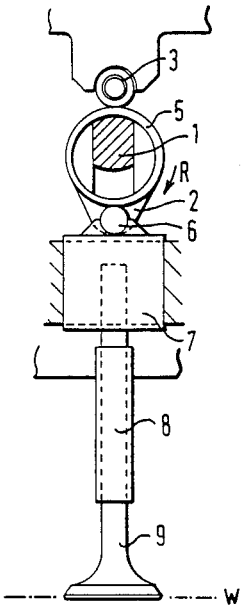
FIGS. 2 to 6 are side views of the FIG. 1 arrangement, showing a camshaft of the arrangement in five different rotational positions.

As can be seen from FIG. 2, when diametrically opposite the reference roller, the cam lobe 2L does not contact the valve bucket 7, thereby ensuring that the only cam action involved is that between the lobe 2L and the reference roller 3.

Figure 3:
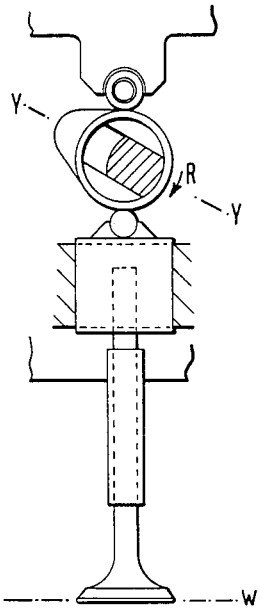
Figure 4:
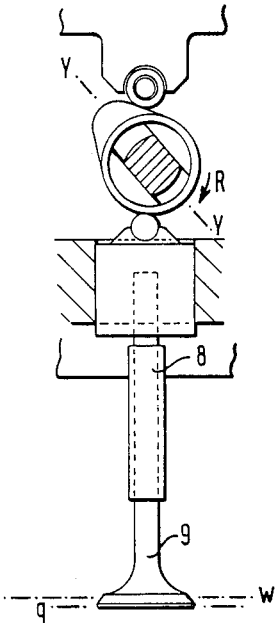
Figure 5:
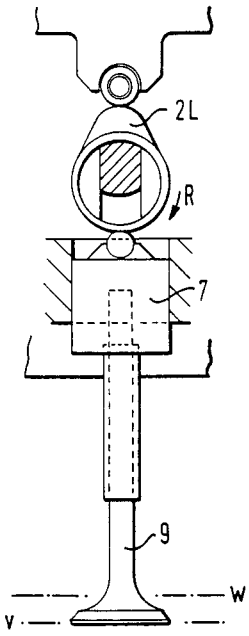
Figure 6:
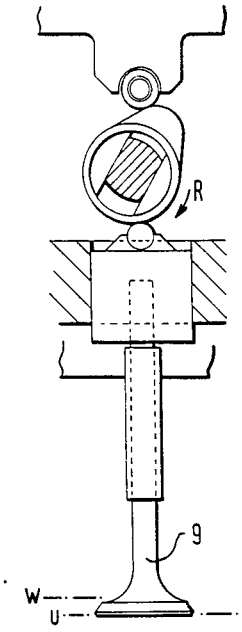

FIG. 3 shows the cam 2 rotated to the point of activation, at which the opening ramp of the lobe 2L is about to create eccentric pressure upon the cam 2 and its output rings 4, 4A, the valve 9 still being in the closed position. In FIG. 4 the continuing rotation of the camshaft 1 has caused the valve 9 to be moved away from its closed position w to a partially open position q. Further rotation into the position shown in FIG. 5 brings the valve into its fully open position v, while continued rotation leads to closing of the valve, as indicated in FIG. 6 where the valve 9 has reached the partially closed position u in returning to the fully closed condition.

Figure 7:
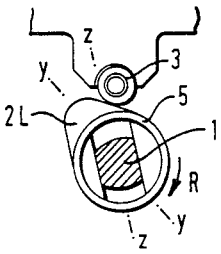
FIG. 7 illustrates a possible modification in the angular positioning of the lobe of a cam of the FIG. 1 arrangement.

FIG. 7 illustrates a possible modification in the positioning of the cam lobe. Thus, in the arrangement of FIGS. 1 to 6, the datum line y—y of the cam lobe 2L coincides with the datum line z—z of the parallel surfaces of the camshaft 1. However, in the arrangement of FIG. 7, the datum line y—y through the cam lobe 2L is angularly shifted relative to the datum z—z of the parallel surfaces of the camshaft 1. The datum y—y is shown in the same angular position in FIGS. 7 and 4. This rearward angular displacement of the cam lobe 2L relative to the parallel surfaces of the camshaft 1 allows a much greater mechanical advantage to be given to the sliding cam 2 during opening movement of the valve 9, since the angle of the parallel surfaces in the arrangement shown in FIG. 7 is more in alignment with the intended direction of travel of the cam and its output rings. During the closing movement, on the other hand, there is a greater degree of mechanical disadvantage but, as the loading is much less since the valve spring is not being compressed, this can be tolerated.

It may be desirable to include a roller assembly on the cam 2, that is between the cam and the parallel surfaces of the camshaft on which the cam slides. It is also envisaged that the cam could carry a single output ring, if desired.

FIGS. 8 to 11 illustrate a second arrangement embodying the invention, which is fundamentally similar to the arrangement of FIG. 1, but in which provision is made for adjustment of the reference roller 3 along a circular path concentric with the axis of rotation of camshaft 1, thereby enabling the timing of the operation of the valve 9 by the cam 2 to be varied.

Figure 8:
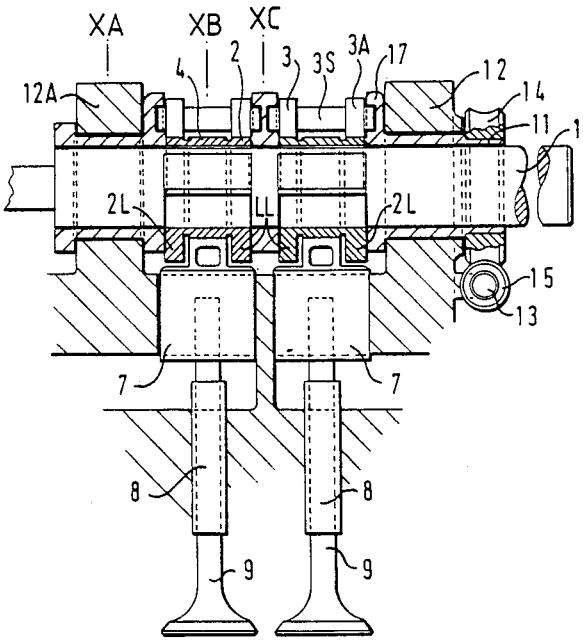
FIG. 8 is a partially sectioned front elevational view of a second poppet valve arrangement embodying the present invention.
Figure 9:
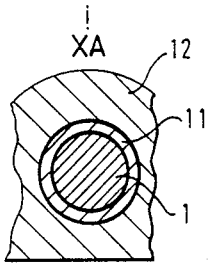
FIG. 9 is a cross-sectional view on the line IX of FIG. 8.

FIG. 8 represents a typical two valve section of a four valve cylinder head, that is a cylinder head provided with two inlet and two outlet valves per cylinder. The layout has been drawn with the two valves 9 (inlet or exhaust) situated in very close proximity in order to demonstrate that it is possible to accommodate an arrangement embodying the present invention within the confines of existing cylinder head designs.

The two poppet valve arrangements shown in FIG. 8 are substantially identical and operate in unison. As shown in FIG. 8, the bucket 7 of each valve 9 is actuated by a double cam 2 having a pair of lobes 2L and LL interconnected by a single output ring 4. Each reference roller 3 comprises two large diameter portions 3, 3A respectively for engagement by lobes LL and 2L and carried by a roller shaft 3S of smaller diameter.

The camshaft 1 passes concentrically through bearings provided on the inside of a sleeve shaft 11 which itself is rotatably supported in bearing members 12, 12A formed on the cylinder head. The sleeve shaft 11 is provided with three eccentric lobes 17 which carry bearings rotatably supporting the two roller units 3, 3A, 3S therebetween. A worm-wheel 14 is attached to sleeve shaft 11 for rotation therewith and is engaged with a worm 15 provided with a drive shaft 13. The lead angle between the worm and the worm-wheel is a locking angle such that the worm-wheel is rotatable by the worm but the worm is not rotatable by the worm-wheel. The drive shaft may be coupled to any suitable means, such as an electric motor, for rotating the worm by a desired amount. It is envisaged that other means of rotating the sleeve shaft 11 could be used, such as a spur gear coupling or pulley arrangement, but a means of locking the sleeve shaft in its adjusted angular position must also then be included.

Figure 10:
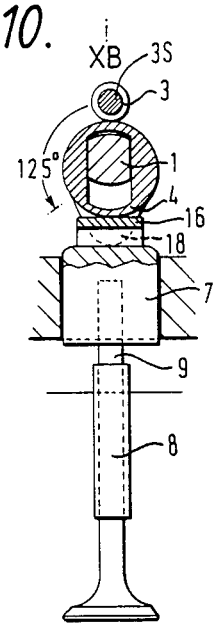
FIG. 10 is a cross-sectional view on the line X of FIG. 8.
Figure 11:
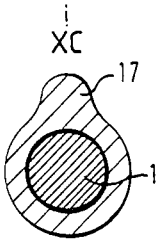
FIG. 11 is a cross-sectional view on the line XI of FIG. 8.

Each valve bucket 7 is engaged by the output ring 4 of the respective cam 2 via a contact shoe 16 which is formed with an aperture 18 in order to save weight, as shown in the cross-sectional view of FIG. 10.

In operation of the arrangement shown in FIGS. 8 to 11, rotation of the camshaft 1 causes the double cams 2L, LL to reciprocate on the camshaft and thereby to operate the valves 9 in unison through the contact rings 4.

The timing of the valve event of both of the valves may be adjusted together by rotating the worm 15 in order to rotate the worm-wheel 14 and thereby rotate the sleeve shaft 11 and its eccentrics 17. Such rotation of the sleeve shaft 11 thus causes displacement of the reference rollers 3 along circular paths centered on the axis of rotation of the camshaft 1, thereby to vary the point during the rotation of the camshaft 1 at which the cam lobes 2L, LL act on the reference rollers and consequently actuate the valves 9. From the cross-sectional view of FIG. 10, it can be seen that the reference rollers 3 have, in this embodiment, approximately 125° of rotational travel in either direction, thereby providing a total range of 250° of angular adjustment.

Assuming that the camshaft 1 is running at half the speed of a crankshaft of the engine in the usual manner, then the mid-point of the angular range of adjustment of the reference roller 3 will correspond to top dead centre.

The angle between the datum of each cam lobe LL and 2L and the parallel surfaces of the camshaft 1 will determine a fixed timing of the cam lobe relative to the top dead centre position. If the sleeve shaft 11 is then rotated to move the reference roller 3 away from the top dead centre position in either direction, then the timing of the actions of the cams upon their respective valves will be either advanced or retarded relative to the originally determined timing and the amount of cam action will be varied. If, at the same time as the rotational positioning of the reference rollers is altered, the camshaft 1 is subjected to an alteration of timing relative to the crankshaft, then complete flexibility will be obtained in determining the timing and extent of the valve event, with complete closing down of the operation of a valve being possible by rotating sleeve shaft 11 through 90° away from the top dead centre position.

The arrangement illustrated in FIG. 8 involves two identically constructed valves operating in unison.

However, it is envisaged that it will be possible to operate the valves independently by providing a separate means of adjusting the reference roller 3 for each valve 9.

Figure 12:
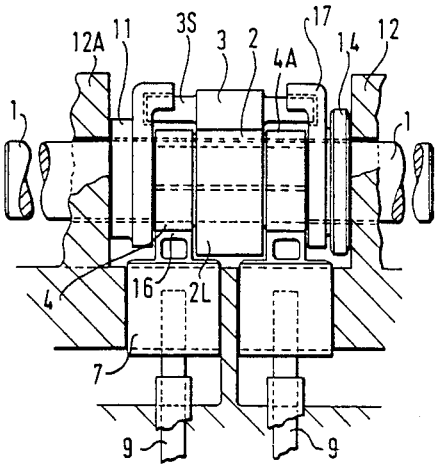
FIG. 12 is a partially sectioned front elevational view of a third poppet valve arrangement embodying the present invention.
Figure 13:
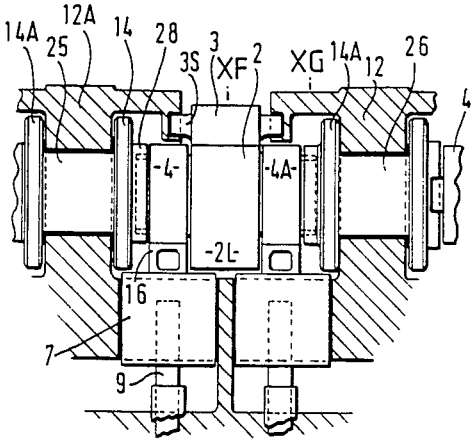
FIG. 13 is a partially sectioned front elevational view of a fourth poppet valve arrangement embodying the present invention.
Figure 14:
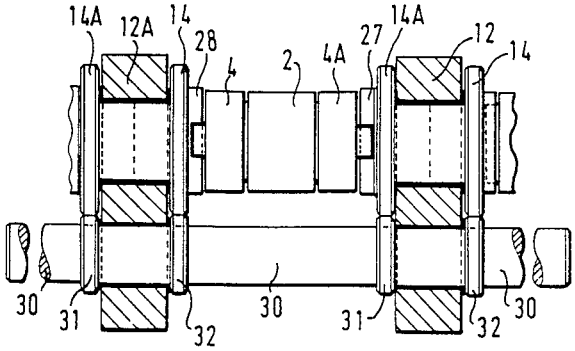
FIG. 14 is a plan view of the poppet valve arrangement of FIG. 13.
Figure 15:
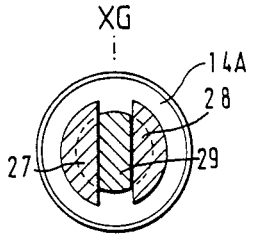
FIG. 15 is a cross-sectional view on the line XV of FIG. 13.

FIG. 12 illustrates a third embodiment of the invention which is a modification of the second embodiment and in which a single reference roller 3 is supported by an eccentric carrier 17 formed on a sleeve shaft which is rotatable about the axis of rotation of the camshaft 1 by means of a suitable adjusting mechanism 14, which may be in the form of a worm and worm-wheel arrangement. In the arrangement of FIG. 12, a single cam 2 engages a central larger diameter portion of the reference roller 3 and is provided with two output rings 4, 4A operating a pair of respective valves 9 in unison in response to sliding movement of the cam 2 on the parallel surfaces of the camshaft 1.

FIGS. 13 to 16 illustrate a fourth embodiment of the invention, in which a pair of valves 9 are operated together by a single reciprocable cam 2 having a lobe 2L and provided with output rings 4, 4A acting on contact shoes 16 of the valves 9.

A pair of hub units 25, 26 is provided with a pair of driven spur gears 14A, 14 engaged by respective driving spur gears 31, 32 provided on a driving lay-shaft 30.

The cam 2 is biased on the valve springs (not shown) into contact with reference roller 3 which is supported in a fixed position by bearing members 12, 12A, so that upon rotation of the hubs 25, 26, the cam slides in the slots of the extensions 27, 28 and thereby actuates the valves 9.

Figure 16:
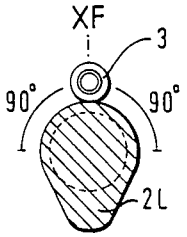
FIG. 16 is a cross-sectional view on the line XVI of FIG. 13.
Figure 17:
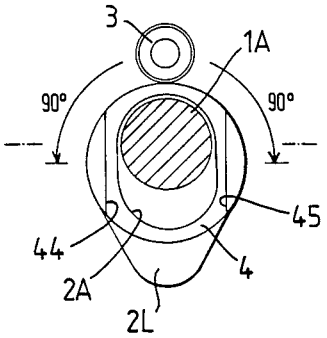
FIG. 17 is a diagrammatic side view illustrating part of a fifth poppet valve arrangement embodying the invention.
Figure 18:
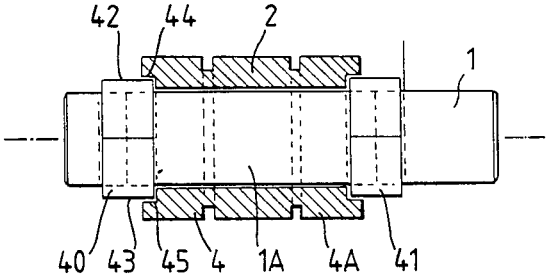
FIG. 18 is a plan view of the FIG. 17 arrangement.
Figure 19:
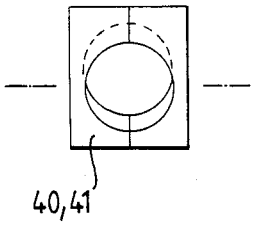
FIG. 19 is a side view of an eccentric bearing block of the FIG. 17 arrangement.
Figure 20:
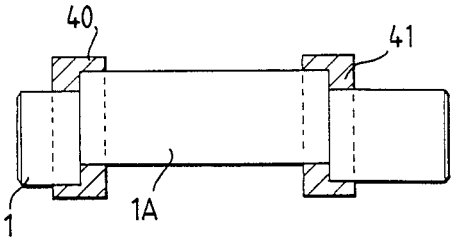
FIG. 20 is a partially sectioned front elevational view illustrating the mounting of a camshaft in bearing blocks of the kind illustrated in FIG. 19.

It is envisaged that the reference roller 3 in FIGS. 13 to 16 could be adjustable about the axis of rotation of the hubs 25, 26 as shown in the cross-sectional view of FIG. 16, being movable through at least 90° in each direction.

In the above described embodiments of the invention, the parallel surfaces guiding the reciprocal movement of the cam transversely of the axis of rotation of the rotatable shaft are provided on the rotatable shaft itself. FIGS. 17 to 20 show that a different approach is possible.

The arrangement of FIGS. 17 to 20 employs a cranked camshaft 1 having an eccentric portion 1A on which is received a reciprocable cam 2 provided with output rings 4, 4A and having a aperture 2A therethrough which is elongated transversely of the axis of rotation of the camshaft 1. Attached to the camshaft 1, 1A are eccentric bearing blocks 40, 41 which are of two-part construction and clamp onto the camshaft 1 at its respective junctions with the portion 1A. The blocks 40, 41 thus reinforce the camshaft at these junctions and are rotatable with the camshaft. Each of the blocks 40, 41 presents parallel surfaces 42, 43 slidably engaged by corresponding surfaces 44, 45 on the respective output ring 4, 4A so as to guide the cam for movement transversely of the axis of rotation of the camshaft 1 upon rotation of the camshaft. As in the preceding embodiments the cam 2 is held in contact with reference roller 3 so that the reciprocating movement is induced by the lobe 2L of the cam during rotation of the camshaft.

The torsional loadings on a camshaft in an arrangement embodying the invention will not be as high as those imposed upon normal "solid" type camshafts, for, as the shaft rotates, the reciprocating cam will slide across the axis of the shaft, thereby continuously shortening the lever arms length between the tip of the cam and the centre of the shaft. In conventional camshafts, this cannot happen, with the result that the leverage increases with rotation up to the point of maximum peak. The torsional requirements for a conventional camshaft are therefore necessarily very considerable. However, although the "square" sections shown in the various embodiments of the present invention reduce the torsional abilities of the component concerned, there is, in fact, no need for the dimensions to be increased to compensate for this, as the torsional and bending parameters are very much lower the arrangements embodying the invention.

What is claimed is:

1. An arrangement for converting rotary motion into linear motion, comprising: a first member; means supporting the first member for rotation about an axis; a second member; means guiding the second member for linear movement in a direction transverse to the axis of rotation of the first member; a follower member having a cam surface and carried by the first member for rotation with the first member around the axis of rotation of the first member; means guiding the follower member for limited linear displacement relative to the first member transversely of the axis of rotation of the first member; and a fixed reference point located at a predetermined distance from the axis of rotation of the first member; the follower member being disposed between the fixed reference point and the second member with the follower member held in contact with the second member and the cam surface of the follower member held in engagement with the reference point, whereby on rotation of the first member the follower member imparts linear movement to the second member in the direction transverse to the axis of rotation of the first member.

2. An arrangement according to claim 1, in which the first member extends through an aperture in the follower member, the aperture being elongated in the direction transverse to the axis of rotation and the cross-sectional shapes of the first member and follower member are such as to cause the follower member to rotate with the first member, whislt permitting displacement of the follower transversely of the axis of rotation.

3. An arrangement according to claim 1, in which the first member is a shaft.

4. An arrangement according to claim 3, in which the shaft has at least one flat surface extending parallel to the axis of rotation.

5. An arrangement according to claim 4, in which the shaft has a pair of flat surfaces extending parallel to the axis of rotation and to one another.

6. An arrangement according to claim 3, in which the first member is a camshaft.

7. An arrangement according to claim 6, in which the second member is a valve to be actuated by the camshaft.

8. An arrangement according to claim 7, in which the follower member has a valve-actuating cam profile and contact means which is normally contacted by an operating portion of the valve.

9. An arrangement according to claim 8, in which the contact means comprises a pair of contact rings projecting from the follower member on axially opposite sides of the cam profile.

10. An arrangement according to claim 8, in which contact between the contact means of the follower member and the valve is established via roller means.

11. An arrangement according to claim 1, in which the reference point is the point of contact between a fixed reference roller and the follower member.

* * * * *